United States Patent [19]

Heng et al.

[11] Patent Number: 4,724,287

[45] Date of Patent: Feb. 9, 1988

[54] VERSATILE MULTIDECK ROTARY SWITCH

[75] Inventors: Jean-Paul Heng, Lyon; André Marmonier, Bron; Etienne Briquet, Rillieux La Pape, all of France

[73] Assignees: Cgee Alsthom, Perret; Baco, Cedex, both of France

[21] Appl. No.: 790,591

[22] Filed: Oct. 23, 1985

[30] Foreign Application Priority Data

Oct. 26, 1984 [FR] France ..... 84 16446

[51] Int. Cl.[4] ..... H01H 21/00

[52] U.S. Cl. ..... 200/14; 200/6 B; 200/153 LB; 200/307

[58] Field of Search ..... 200/4, 5 R, 6 R, 6 B, 200/6 BA, 6 BB, 11 R, 14, 17, 153 LA, 153 LB, 307

[56] References Cited

U.S. PATENT DOCUMENTS

| | | | |
|---|---|---|---|
| 2,912,527 | 11/1959 | Naimer | 200/6 BB |
| 3,094,592 | 6/1963 | Fisher | 200/6 R |
| 3,251,956 | 5/1966 | Rasor et al. | 210/14 |
| 3,260,803 | 7/1966 | Moroishi | 200/6 B |
| 3,303,313 | 2/1967 | Okamoto | 200/11 R X |
| 3,493,696 | 2/1970 | Rothweiler | 200/14 X |
| 3,767,880 | 10/1973 | Austin | 200/318 |

FOREIGN PATENT DOCUMENTS

| | | |
|---|---|---|
| 930332 | 6/1955 | Fed. Rep. of Germany . |
| 1226685 | 10/1966 | Fed. Rep. of Germany . |
| 2,363,983 | 6/1975 | Fed. Rep. of Germany . |

*Primary Examiner*—J. R. Scott

*Attorney, Agent, or Firm*—Sughrue, Mion, Zinn, Macpeak & Seas

[57] ABSTRACT

The rotary switch consists of a plurality of switch decks and is designed to be mounted on a support (2) by a mounting plate (3). At one of its ends it is operated by a control shaft (4) which actuates contacts by cams (5) located in switch modules (9,10). The moving members of a plurality of electrical contacts are also located in the modules stacked about the control shaft. The switch body is provided with two through holes (13, 14) aligned with the axis of the control shaft (4). One of the holes goes through the mounting plate (3) and the other through an end plate (12), at the opposite end of the switch from the mounting plate. Each through hole allows the shaft to rotate therein as required. The mounting plate (3) and end plate (12) includes a ring recess (15 or 16) for ring (17) serving to limit the angle of shaft rotation. One of the through holes includes a lock (19) for locking against axial movement the assembly formed by the shaft and the cams it controls. The lock (19) contains the ring recess (16) of the through hole of which it forms a part. The switch can be mounted either in a panel (flush) or on a wall (projecting) merely by reconfiguring the assembly of its components.

9 Claims, 12 Drawing Figures

VERSATILE MULTIDECK ROTARY SWITCH

FIELD OF THE INVENTION

This invention relates to multideck electrical switches operated by a rotary-type control element or actuator and in particular to such switches which may be either flush mounted or wall mounted.

BACKGROUND OF THE INVENTION

Multideck rotary switches, also called multi-wafer switches, typically consist of a plurality of contacts arranged in groups. The contacts may be grouped in pairs, in modular form and known as decks or wafers. The decks or wafers may be stacked one upon another. Each contact in a group comprises at least one stationary contact member and one moving contact member. The contact members are electrically connected to terminals accessible to the outside of the switch to which external conductors are connected.

The moving contact members of such a switch are operated by a common rotary control shaft. The shaft typically goes through the center of several decks of a unit formed by stacking a wafer modules. The control shaft may project from one end of the switch. That end normally has fixed thereto a rotary control knob for manual control of the switches. Alternatively, there may be some other control member for switch operation by means of a servomechanism.

The terminals associated with different control members and mounted in a column parallel to the control shaft must be so located as to be readily accessible when the multi-deck rotary switch is connected to external wires leading to the electrical apparatus being served by the switch.

In particular, such switches are typically flush mounted. In such a case, the body of the switch is attached to a supporting panel at its front end, such that the control shaft, which projects from the front end also projects from the panel to a distance sufficient to accommodate the mounting of a rotary control member. Alternatively, they are mounted so as to project from the supporting panel. Such mounting is normally termed a wall mounting with the body of the switch at its back or opposite end from which the shaft projects. Under such an arrangement, the shaft as well as the switch body is mounted on the same side of the supporting panel or wall and the shaft does not penetrate through the wall.

If the terminals of such a switch are arranged so that their axes are roughly perpendicular to the axis of the control shaft it is normally an easy matter to fasten wires to the terminals, as long as the switch is not installed. Thus, choosing between flush mounting or wall mounting of the switch is no problem.

However, experience shows that it is not always easy to make connections for the electrical apparatus to be served once a switch has already been installed. To avoid having such difficulty or indeed the impossibility of making the connections, it is common practice to make the connections in two stages. First, auxiliary leads are connected to the terminals of the switch on a bench, prior to installing the switch. Later, after the switch has been installed, these auxiliary leads are connected to an outside terminal block which also receives the leads from the electrical apparatus to be served by the switch.

This in not an advantageous solution, since it involves double connections and an intendant waste of time and increase risk of making faulty or wrong connections. Besides, this fails to solve the problem of accessing the terminals of an installed switch for servicing purposes.

Accordingly, switches have been designed with terminals arranged obliquely so that their axes are slightly inclined with respect to the axis of the control shaft and with the terminals flaring out from the shaft in a direction away from the mounting end of the switch. This design makes the terminals accessible under all situations, provided access to the back of the switch body is still possible.

On the other hand, it is typically not possible to alternatively flush mount and wall mount a switch with obliquely arranged terminals as described above. In one of these two alternatives, the wall or panel on which the switch is mounted necessarily interferes with the operation of connecting the wires to the terminals, unless the two stage procedure described above is used.

The present invention provides an alternative to the necessity of providing two types of oblique-terminal switch units, one type for wall mounting and another type for flush or panel mounting. The present invention provides a versatile switch design accommodating either mount by the mere permeation of component parts, enabling easy adjustment of the extent of control shaft projection while permitting modification in the number of switching decks making up the switch.

SUMMARY OF THE INVENTION

The invention involves a basic multi-wafer rotary switch designed to be fastened by a mounting plate, located at one of its ends, to a support. The switch is operated by means of a rotating shaft operatively movable to at least two different angular positions. The shaft actuates, by means of cams, the moving members of electrical contacts distributed among a plurality of stacked wafer modules or decks. The stack wafer modules are traversed by the axis of the control shaft which passes through the stack. The control shaft contains the cams. The electrical contacts further include stationary contact members which are connected, inside respective modules to connecting terminals. The terminals are accessible from the outside of the switch. The terminals are arranged obliquely with respect to the control shaft axis. Further, the terminals have their axes slightly inclined relative to the shaft axis so as to converge in the direction of the end of the switch which carries the mounting plate.

A first feature of the invention lies in the switch having two through holes in alignment with the control shaft axis. One of the holes is located in the mounting plate and the other in a fixed end plate located at the opposite end of the switch from the mounting plate. The feature lies in allowing the control shaft through at least one of the tube plates. Each of the holes allows the shaft to rotate. The fixed end plate and the mounting plate about the holes includes a ring recess to accommodate at least one angular positioning fitted to the shaft to limit the shaft's rotation. The angular positioning ring cooperates with at least one matching, fixed stop provided in the corresponding ring recess from which the shaft projects. One of the holes is provided with a lock for axially locking the assembly consisting of the shaft and the cams aligned therewith whose operation is controlled by the shaft. The lock is contained within the ring recess of the bushing and the bushing carries a longitudinal bore for selectively permitting the shaft to project from the switch through the end plate when in a non-flush mounting of the switch.

Another feature of the invention, complementing the first is that the lock is part of the bushing and located in the hole through the end plate of the switch, specifically at the outermost end of the hole, to enable the shaft and the cams to be installed in the switch through the end plate. Another complementary feature of the invention is the locating of the ring recess provided with the lock which is outermost with respect to the switch. When the lock is installed, a cylindrical bearing part is provided in the axially inward facing end of the lock to receive the cylindrical end piece of a cam. This enables the axial locking of the cam and cam shaft assembly by means of that bearing part.

Yet another complementary feature is that the cams are axially fixed to the shaft by clamping on a collar which is fixed to the shaft. The clamping action occurs either between two superposed cams or between a cam and, directly or indirectly, a plate so as to permit adjustment in the amount of shaft projection from the switch body, regardless of whether the switch is flush mounted or wall mounted.

Still another complementary feature is that the switch includes a wafer module serving to position the control shaft, the cams or both, near the mounting plate by means of a bearing from the positioning cam. The bearing is centered on the shaft axis and snugly engages the contact cam behind the bearing in the line up of nested cams. The positioning cam has the same outside diameter as the contact cam so as to facilitate the insertion of the cam shaft assembly (shaft and cams) through the switch end plate and the concentric wafer modules.

The invention, as well as its features and advantages will now be described in greater detail with reference to the appended drawings.

DESCRIPTION OF THE PREFERRED EMBODIMENTS

Within the Figures, like elements bear like numerals with additional letter and prime designations where appropriate.

Figure 1:
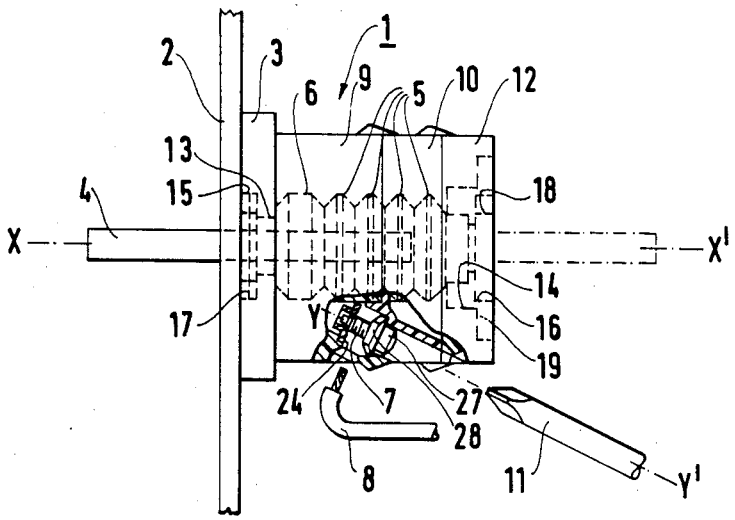
FIG. 1 is a schematic view for a switch forming one embodiment of the invention and illustrating the nature of its electrical connection and the alternative flush or wall mounting of the switch to a panel.

FIG. 1 shows a switch 1 designed to be mounted behind a supporting panel 2 by a mounting plate 3 located at one of the ends of the switch 1. The components of the switch are defined in relation to its longitudinal axis X—X' which coincides with the axis of a control shaft 4 serving to actuate the moving members of the switches electrical contacts. The electrical contacts have been omitted from FIG. 1.

Figure 2:
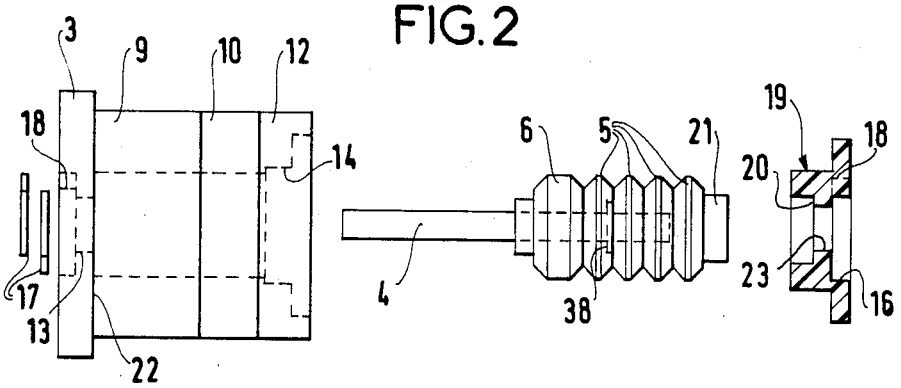
FIG. 2 is a schematic, exploded view of the switch of FIG. 1 showing the arrangement of certain key features of the switch employed in flush mounting.
Figure 3:
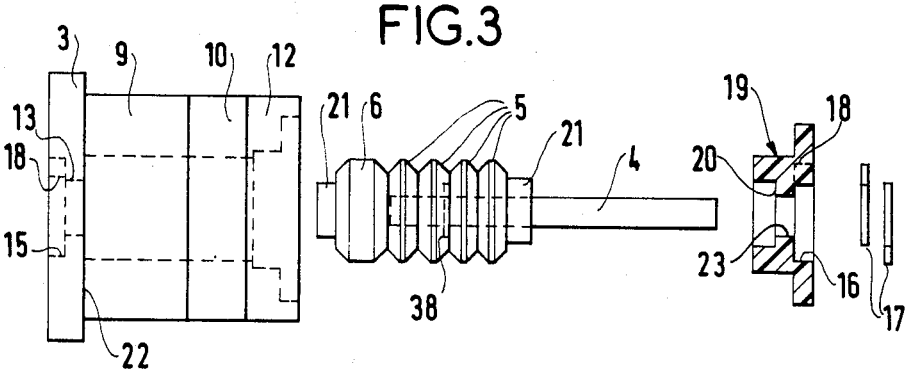
FIG. 3 is a schematic, exploded view showing the switch of FIG. 1 and the key features employed in wall mounting of the switch.

To this end, the control shaft 4, drives cams 5 in rotation about the shaft axis which cams actuate the moving contact members, as well as typically, a locating or positioning cam 6. The electrical contacts also comprise fixed members (not shown) but which are connected to wiring terminals to which are connected electrical wires 8 coming from electrical apparatus (not shown) external of the switch. The fixed and movable electrical contacts are typically provided in groups of, usually, an even number of contacts, having their connecting terminals and their acutating cams located in module stack one upon another in the direction of the switch longitudinal axis x—x'. Two such modules are illustrated in FIGS. 1, 2 and 3 at 9, 10.

Figure 5:
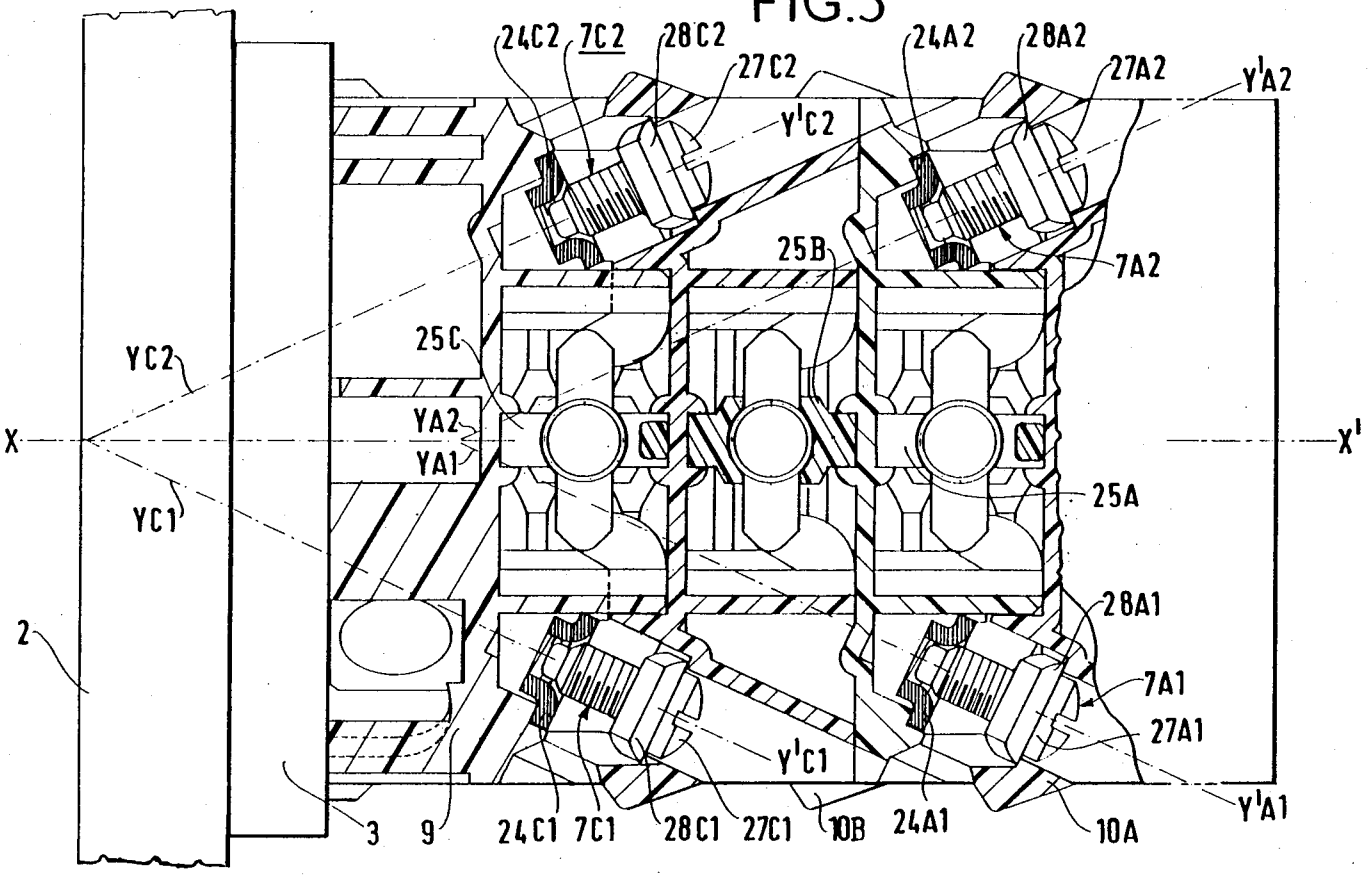
FIG. 5 is a cut-away view, taken along V—V of FIG. 7, illustrating the arrangement of the connecting terminals of the switch of FIG. 4.

The terminals 7 may be any suitable common type and may in particular be screw terminals having a clamping tab 28 as shown in FIG. 1 mounted on a screw 27 which screw 27 engages in a fixed conductor blade 24. This may be seen in greater detail in FIG. 5, where terminal 7A1 is seen as consisting of a clamp 28A1, screw 27A1 and blade 24A1. Each connecting terminal 7 is located so as to be accessible from the outside for insertion of a wire conductor such as 8, an eves in screw driving of the clamping screw 27.

Connections are usually made to the terminal either by pushing, pulling or screwing as indicated for terminal 7 in FIG. 1. It is therefore necessary for the terminal to be accessible in a direction which will be referred to hereinafter as its operating direction and designated in FIG. 1 as axis Y—Y'. In the example illustrated, the blade of a screwdriver 11 must be approached along the screw's operating axis Y—Y', which in this case is also its screwing axis.

For the reasons stated in the foregoing, the terminal 7 and its operating axis Y—Y' are arranged obliquely to the axis X—X' of the control shaft 4, said axis Y—Y' being slightly inclined toward said shaft axis X—X' so that it, and all the other operating axes of the other terminals generally converge in the direction of the mounting plate 3.

Since the switch 1 is designed to be mounted either way, i.e., flush or projecting, it is necessary that the shaft 4 be able to provide either from the mounting plate 3 and mounting panel 2, or from an end plate 12 while closing off the switch body at the opposite end from the mounting plate 3. Obviously, the switch cannot be mounted to a support by this end plate 12 without blocking access to the terminals along their operating axes.

The invention accordingly provides two bushings having through holes 13 and 14 in line with the control shaft axis X—X', one of said bushings within the mounting plate 3 and the other within the end plate 12, to enable the shaft 4 to protrude from at least one of the plates 3 or 12 as shown by the solid lines (leftwards) and by the broken lines (rightwards) in FIG. 1.

Figure 6:
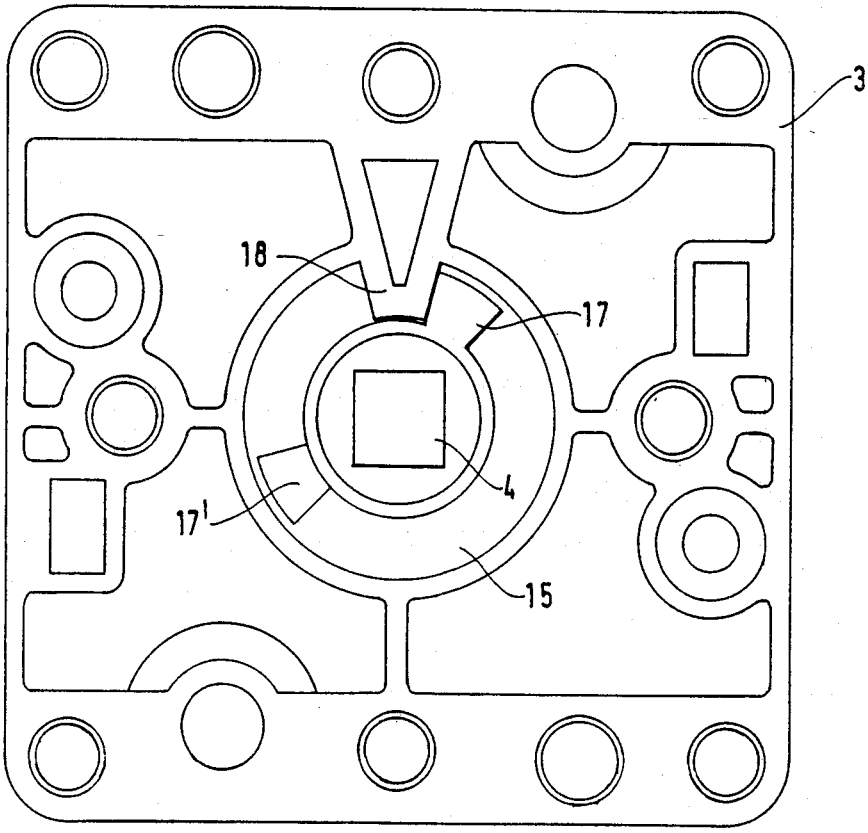
FIG. 6 is a top plan view of a mounting plate for the switch shown in FIG. 4.

Each through hole 13, 14 allows the shaft 4 to rotate when journaled therein and has a ring recess 15 or 16 in one of its ends to receive at least one ring designed to limit the angle of rotation, such as angle limiting ring 17 rotating with the shaft 4, to which it is locked, as will be further described hereinafter with reference to FIG. 6.

This angle limiting ring 17 limits the rotation of the shaft about if axis by cooperating with at least one mating stop fixed in the ring recess, for example with stop 18 of ring recess 16 in the broken line alternative showing of FIG. 1, where said ring is in ring recess 16.

One of the holes 13 or 14 further holds a lock 19 for locking axially, i.e., against translation, the assembly formed by the shaft 4 and the cams 5 and 6 which it drives in the switch 1.

The lock 19 contains the ring recess of the hole which contains it; for instance, lock 19 contains recess 16.

For reasons of convenience at the time of building up a switch that will be further elaborated hereinafter, lock means 19 is preferably housed and held fast in the outside portion of the end plate 12 and said lock ring recess 16 opens toward the outside of the switch. Similarly, ring recess 15 of mounting plate 3 is also preferably facing the outside of the switch and thus the support or panel 2.

The angle limiting ring or rings 17 is or are mounted in whichever ring recess 15 or 16 the control shaft 4 protrudes from, according to the type of slush or wall mounting selected.

The arrangement of the key features, i.e., of the shaft and angle limiting rings, of the switch is thus designed to be modified to suit the desired mounting alternative as shown in FIGS. 2 and 3, and it is therefore paramount to have easily interchangeable components.

The flush mounted switch (FIG. 2), which is intended, then, to have its shaft 4 traverse the mounting plate 3 and the supporting panel (not shown), provides for limiting said shaft's rotation by means of one, or in this case two, angle limiting rings 17. The angle limiting rings are placed in the ring recess 15 of the mounting plate 3 and designed to cooperate with the stop 18 on the wall of the ring recess.

The control shaft 4 does not necessarily traverse the entire switch, for it is locked against translation by cams 5 and 6 as will be explained hereinafter. The assembly consisting of said shaft and the aligned cams 5 and 6 is inserted into the switch through the end plate 12 and the switch modules 10 and 9. It is locked by lock 19 which limits the translation of the cams 5 and 6 between the lock and the mounting plate. The lock has like the latter, a bearing for the cam end pieces or journals 21 appearing at both ends of the cam assembly.

The same switch, when in wall-mounting configuration (FIG. 3), is designed to have its shaft 4 traversing the end plate 12, or to put it more exactly, traversing the lock 19 immobilized in said end plate.

The assembly consisting of the cams 5 and 6 and the shaft 4 protruding from said assembly on the side of the cams 5 is inserted into the switch through end plate 12 and through switch modules 10 and 9. It is locked against translation by the lock 19 and the mounting plate via the bearing 20, 22 of these two components just like the previous shaft. The control shaft 4 transverses lock means 19 via a bore 23 allowing it to rotate. But the rotation is limited in this case by the two angle limiting rings 17 located this time in ring recess 16 so as to cooperate with the stop 18 provided in that recess. The shaft 4 does not necessarily traverse the entire switch, being immobilized by the cams 5 or 6 in the same way as previously mentioned, to be described later herein.

FIGS. 4 through 9 will be the basis for a more detailed description of the invention and its advantages in terms of a specific embodiment.

Figure 4:
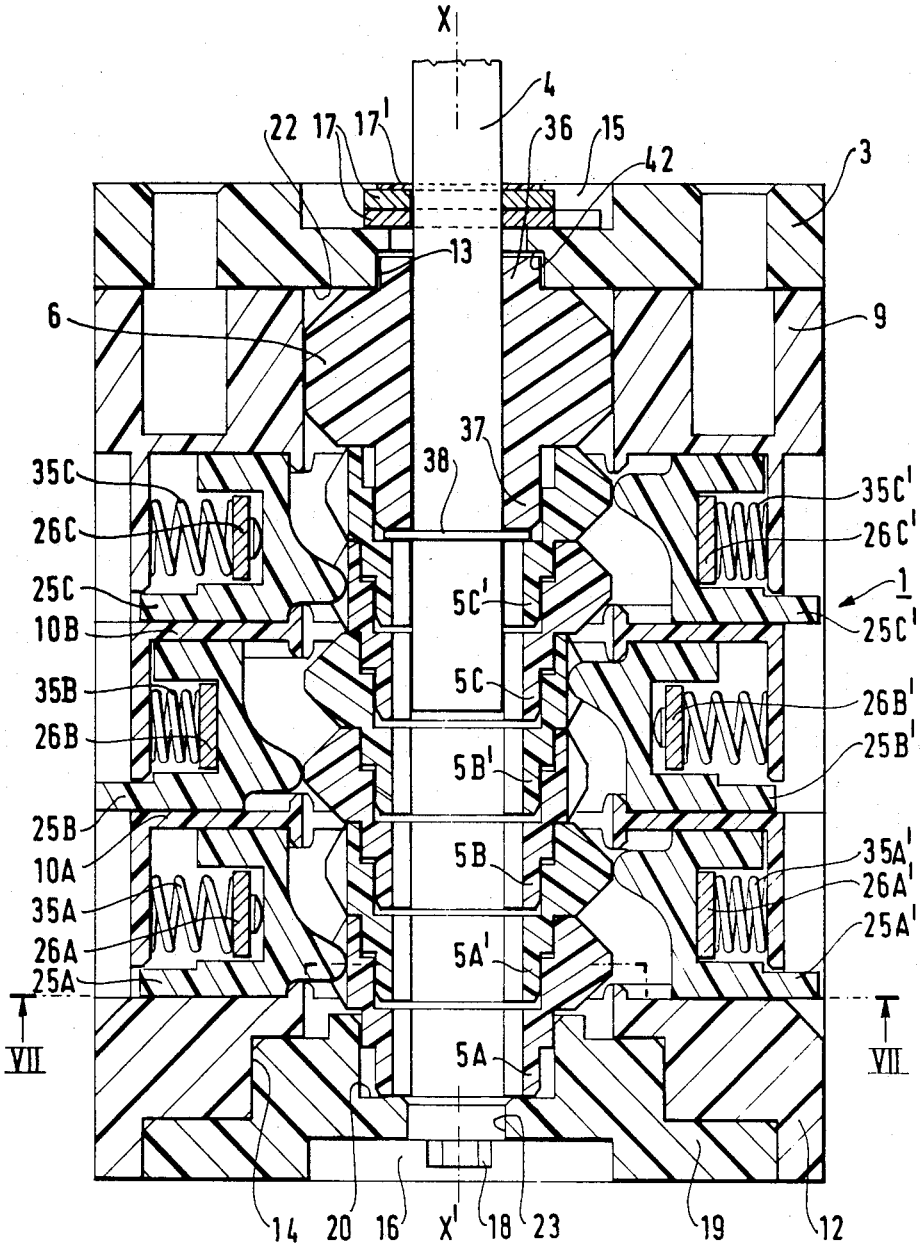
FIG. 4 is a median sectional view of a switch according to the invention as configured for flush mounting.

The electrical switch 1 illustrated in FIG. 4 has decks stacked along the axis X—X' of its control shaft 4, which is positioned in this figure for a flush, panel mounting of the switch.

The several decks can be seen to include the mounting plate 3, a positioning module 9, which in this case is also a contact module, one or more contact modules 10, such as 10A and 10B, and an end plate 12.

The several decks are fastened to one another by some suitable known means not specifically depicted, but consisting for example of bolt fasteners or clips on one module gripping the perimeter of the next-in-line module.

The control shaft 4 axis X—X' runs through the center of the several decks. The shaft 4 can protrude either through the mounting plate 3, via the axial opening or integral bushing 13 of said plate and the axial ring recess 15 into which the latter bushing issues, or through the end plate 12 and more exactly the lock 19, in a manner not illustrated, via the axial bushing hole 14 and ring recess 16 of said lock.

The shaft 4 is designed to drive a series of cams comprising a positioning cam 6 fitting beneath the mounting plate 3, in positioning module 9, as well as contact cams 5, such as 5A or 5C, aligned behind said positioning cam 6, between said mounting plate 3 and said end plate 12.

As many contact cams 5 are provided as there are moving electrical contact members to be actuated.

Figure 7:
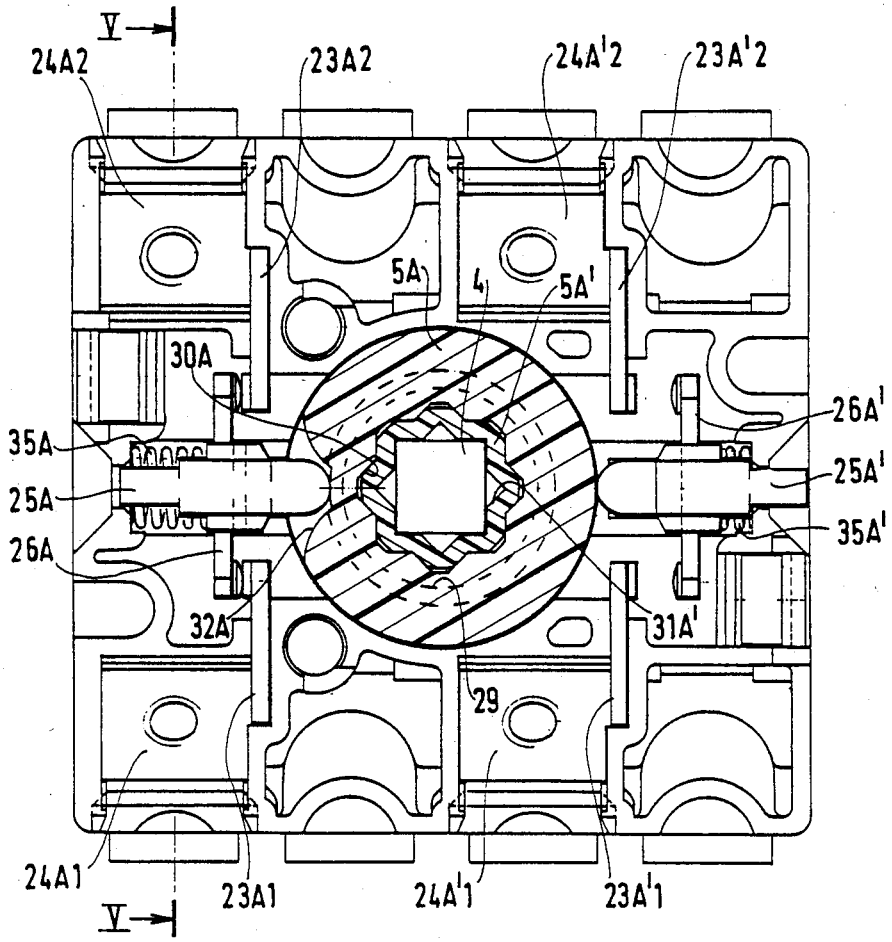
FIG. 7 is a top plan view of a contact module, in cross-section taken along line VII—VII of FIG. 4 showing a contact-actuating cam.

In the embodiment shown, and referring now alternately to FIG. 4 and 7; there are two cams 5 per module, serving to actuate two electrical contacts which are themselves known. These contacts each consist of two fixed contact members (FIG. 7). Each fixed contact member 15 connected a fixed conductor blade 24 of a different (screw) terminal and capable of being electrically connected together under the control of a cam 5 by a moving member 26. The member 26 is carried by a cam follower member 25 slidably actuated by the cam, and biased by a spring 35. Several members, for instance fixed members 23A1, 23A2 respectively, connected to the fixed blades of terminal 24A1 and terminal 24A2 are operable as to be electrically connected together by the moving member 26A carried by cam follower 25A when it is slidably actuated by cam 5A.

As previously indicated, the screw terminals 7 are arranged obliquely in relation to the axis X—X' of shaft 4, such that their operating axes Y–Y' are slightly inclined relative to said axis X–X' and converge toward the mounting plate 3 of the switch. For instance, terminal 7C1 has an operating axis YC1—Y'C1 skewed inwards to meet shaft axis X—X' beyond mounting plate 3 and support 2 in FIG. 5.

The cams 5 are stacked along the axis X'X' of shaft 4, which lodges in at least some of said cams as shown in FIG. 4. Each cam 5, as specifically illustrated in FIG. 8, comprises stepped, axially aligned inside parts as follows, reading the figure from top to bottom; a cylindrical bearing part of circular cross-section; a polygonal recess 30 for driving the cam; and a polygonal through hole 31 for the control shaft. Said polygonal hole 31 opens at the other end of the cam 5 from said cylindrical bearing part 29 and enables passing a shaft through said cam and locking said cam against rotation on said shaft.

Figure 8:
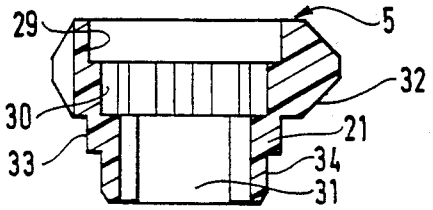
FIG. 8 is a detailed sectional view of one of the contact actuating cams shown nested in FIG. 4.

Each cam also has outside, stepped, axially aligned portions as follows, a first outside bearing 32 has the control profile one desires for the cam, as best seen in FIGS. 7 and 8.

A second outside bearing 33 has a circular cross section and dimensions matching those of inside bearing 29, in order to enable centering one cam 5 in another cam 5 by inserting said second outside bearing 33 of one cam into the internal bearing 29 of the next.

A polygonal end piece 34 with dimensions matching those of mating polygonal recess 30 enables driving a cam 5 by a next cam 5. The end piece 34 of one penetrates into the recess 30 of the other.

Accordingly, it is possible to drive along all the cams 5 of a given train of cams, say trains 5A, 5A', 5B, 5B', 5C, 5C', by means of a shaft inserted through the polygonal bushing 31 of at least one of said cams. As can be seen in FIG. 4, the shaft 4 penetrates only two cams, 5C and 5C1.

Figure 9:
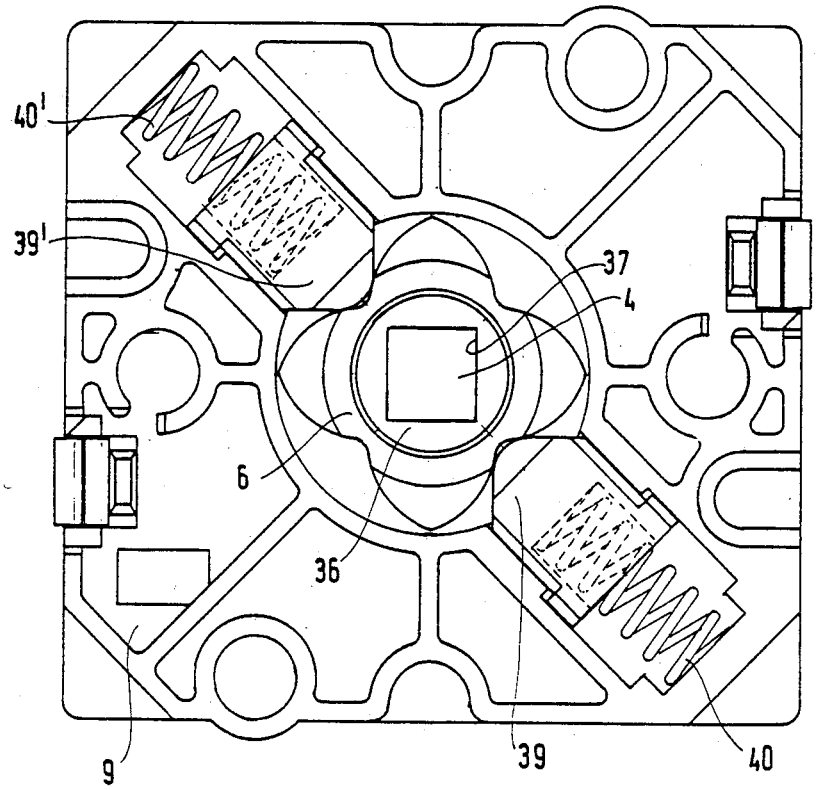
FIG. 9 is a top plan view of a shaft positioning module for a switch as shown in FIG. 4, and FIGS. 10, 11 and 12 are outlined diagrams as three alternate configurations of the switch and shaft arrangement for different mounting of the switch in accordance with the invention.

Typically, as again in FIGS. 4 and 9, the cam train includes a positioning or locating cams 6, being in this case a four-lobed cam, which determines the angular positions which can be assumed by the shaft 4 in rotating about its axis X—X'.

The positioning cam 6 is accommodated in a special positioning module 9, which in the example shown, also acts as a contact module for the nearest contacts thereto.

Positioning cam 6 has a polygonal through-hole 37 having the same cross section as the aforementioned polygonal through hole 31 of the contact cams, such as to also be able to be blocked against rotation on the shaft 4. Cam 6 is provided with a polygonal end piece or shaft 37 like the polygonal end pieces of the contact cams 5, so as to mate with a polygonal recess 30 of a contact cam as the latter do and to the same end, making said cams 5 and 6, stacked along axis X—X', rotatively fast.

Positioning cam 6 includes an axial end piece 36 of circular cross-section which fits into the bushing through hole 13 provided in the mounting plate 3 and bears against the bearing part 22 arranged on said mounting plate.

Axial movement of the shaft. 4 and cam train 5, 6 aligned on its axis X—X' is prevented by the lock 19 between the bearing 20, against which bears the end of the polygonal end piece 34 of the last-in-line contact cam 5A, and the bearing 22 against which bears the opposite end of cam 6 from cam 5A, when the cam train is installed.

The shaft 4 is locked axially within the train of cam 5, 6 between the bearing parts 20, 22 by means of a collar 38 on said shaft. The collar is susceptible of coming between two cams or between an end cam and the corresponding bearing, as will be explained hereinafter.

The positioning cam 6 cooperates in a conventional manner with positioning cam followers 39, 39' (FIG. 9).

Cam followers 39, 39' are spring-loaded by means of hard springs 40, 40' to apply force against the profile of the positioning cam 6. The springs serve to hold the shaft in place in the different angular positions provided for, and to produce a strong resistance to rotation of the shaft during the first part of the rotation between two positions, in order to promote fast switching by the electrical contacts.

At the time of installing the shaft 4 and the train of cams 5, 6 in the switch 1, it is necessary to see the cams' passage through the modules 9, 10 in view of their definitive positioning. This is done by compressing the springs 35 of the cam followers and the positioning springs 40, 40'. To the extent that the latter are much harder springs than springs 35 and that every effort is made to keep the size of cams 5, 6 to a minimum so as to reduce the overall dimensions of the switch, it is preferable not to insert the cam train through the positioning module 9, in order to avoid having to compress the hard positioning springs 40, 40' for other than the actual insertion of the positioning cam 6.

To this end, the train of cams 5, 6 is designed such that the positioning cam 6 has the same extension or maximum diameter as the contact cams 5. Thus the train can be inserted through the end plate 12 and the contact modules 10, positioning cam forward, to the point where the positioning cam 6 enters its module 9.

This is made easier by the presence of the lock 19 which is purposely positioned and secured within end plate 12 following installation of the cam and shaft assembly.

As previously indicated and illustrated in FIGS. 4, 10, 11 and 12, the shaft 4 is designed to be mountable for service in two different switch mounting arrangements. Flush mounting, otherwise known as panel mounting is where the shaft 4 protrudes from the mounting plate 3 of the switch to stick through the support or mounting panel 2. Wall mounting is where the shaft 4 protrudes out the switch end plate 12.

To this end the collar 38 of the shaft 4 is located in the switch either between two nested cams, as in FIG. 4, or between a cam 5 or 6 at one end of the cam train and a bearing part 20 of lock 19, or bearing part 42 of plate 3.

In the first case, the collar 38 therefore lodges at the bottom of the polygonal recess 30 of a cam 5 and beneath the polygonal end piece 34 of the cam 5 fitted into said recess, namely collar 38 between the bottom of the polygonal recess in contact cam 5C' and the polygonal end piece of positioning cam 6.

It is thus possible to adjust the amount by which the shaft 4 projects from the switch 1 in steps by moving the collar 38 of the shaft from one to another of the two positions mentioned above. This can be done, even at the time of installation, as was done concerning the changeover from flush to wall mounting.

Figure 10:
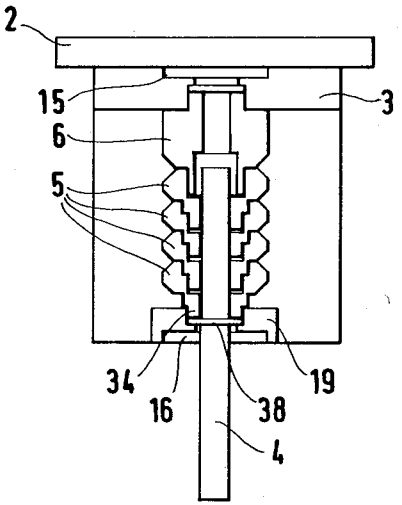

FIG. 10, in fact, shows schematically a switch in wall-mounting configuration, having its shaft collar 38 positioned between the bearing provided in locking means 19 of the end plate and the polygonal end piece 34 of a cam 5 at the end of the cam train, near said locking means.

Figure 11:
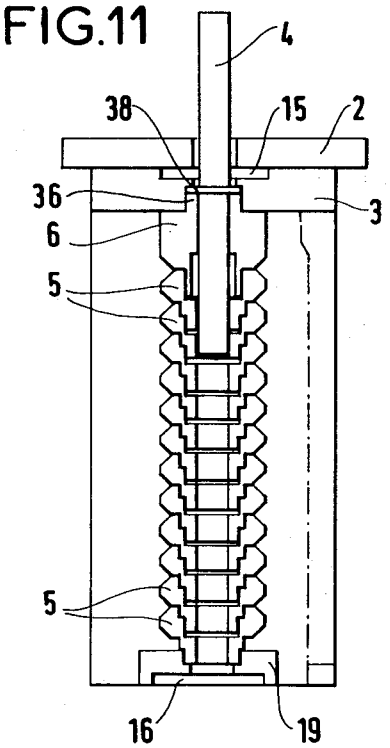

FIG. 11 shows schematically a switch with a greater number of contact modules, symbolized by their cams 5, having its shaft 4 configured for flush, panel mounting. Shaft 4, therefore passes through the mounting plate 3, against which the collar 38 of said shaft 4 bears, clamped, as it is, between the end of the positioning cam 6 end piece 36 and the bearing provided on he mounting plate 3 for said cam 6.

Figure 12:
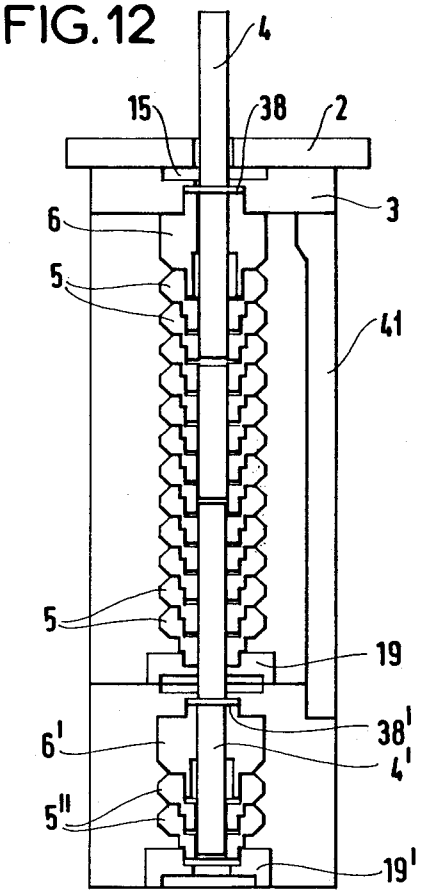

FIG. 12 shows a very large capacity switch constructed by lining up two switches 1, 1' whose shafts 4, 4' are placed in the same position as the shaft shown in FIGS. 11. The shaft 4' goes through lock 19 of the first switch and meshes with the cam 5 of that switch nearest said lock. It is driven by the rotation of the other shaft 4. The switches are made fast together by conventional assembly means 41 which need not be described herein.

Obviously, such an extended, dual body switch can be put together for both of the mounting configurations described in the foregoing. Shaft projection can be adjusted for either according to the aforementioned procedure both during manufacture and installation. The number of decks or modules in any given switch can also be changed by adding or subtracting one or more modules and thus modifying the train of cams and the position of the control shaft.

We claim:

1. A multideck, rotary electrical switch having a fixed end plate, a mounting plate located at one of its ends for mounting on a support, a rotatable control shaft operable to assume at least two distinct angular positions, cams to drive the moving contact members of electrical contacts distributed among a plurality of stacked modules through which said control shaft extends axially, said modules also containing said cams, said electrical contacts further comprising fixed contact members within the modules connected to the fixed blades of wiring terminals accessible from the outside of the switch, said terminals being arranged obliquely to the axis of the control shaft such that their axes of operation are slightly inclined with respect to said shaft axis and converge toward the end of the switch carrying the mounting plate, two through holes provided in line with the shaft axis, respectively in said mounting plate and in said fixed end plate of the switch, said end plate being located at the opposite end of the switch from said mounting plate, said shaft protruding through at least one of said two plates, each plate through hole allowing said shaft to rotate therein, a ring recess in one end of at least one of said plates for receiving at least one shaft-mounted angle limiting ring to limit the range of angular positions assumable by the shaft, at least one matching, fixed stop arranged in said ring recesses having the shaft projecting therethrough for contact with said shaft-mounted angle limiting ring, one of said through holes further being provided with a lock for preventing axial movement of the assembly consisting of said control shaft and the cams aligned on said shaft which controls them, said lock containing the ring recess of the through hole containing said shaft, and including a longitudinal opening for passage of said shaft enabling the shaft to project out of said switch as required to facilitate mounting of said switch either flush with a panel or projecting from a wall.

2. An electrical switch as in claim 1, wherein said lock is located in the through hole of said end plate of the switch in the end of said through hole to the outside of the switch, to enable the shaft and its cams to be inserted into the switch through said end plate.

3. A switch according to claim 2, wherein said ring recess in said lock is located in the end of said lock that faces the outside of the switch when said lock is installed in the switch, a cylindrical bearing part for the cylindrical end piece of a cam being provided in the end of the lock facing the inside of the switch to enable axial locking of the assembly formed by said shaft and said cams by means of said bearing and a complementary bearing of said mounting plate.

4. A switch according to claim 3, wherein said cams provide locking of the shaft against axial movement in relation to themselves by clamping between them a collar attached to said shaft, so as to enable the amount of protrusion of the shaft from the switch to be adjusted whether the switch is flush or wall mounted.

5. A switch according to claim 4, made up of two multideck switches securely fastened in alignment, and wherein the control shaft of one switch is inserted into the lock of the other switch.

6. A switch according to claim 4, further comprising, in addition to said contact modules, a positioning module to position the shaft and the cams nearest the switch mounting plate by means of a cylindrical bearing part for a positioning cam centered on the control shaft axis and fitted into the next-in-line cam of the stack of nested cams, said positioning cam having the same maximum diameter as the contact cams meshed therewith in order to make easier the insertion of the assembly formed by said shaft and said positioning and contact cams through said switch end plate and said contact and positioning modules.

7. A switch according to claim 6, wherein said control shaft projects out of said lock and being rotationally limited by at least one angle limiting ring.

8. Switch according to claim 6, wherein said control shaft projects out of said switch mounting plate and is rotationally limited within said plate by means of at least one angle limiting ring.

9. Switch according to claim 4, wherein said contact cams stacked along the axis of the control shaft in the various modules of the switch each have a stepped internal structure including an axial cylindrical bearing part with a circular cross section, an axial polygonal recess and an axial polygonal through hole for passage of the shaft, in that order, with said passage issuing at the other side of the cam from said cylindrical bearing part and ensuring rotational locking of said cam on said shaft with said shaft projecting through said cam, and wherein said cams are each given a stepped outer structure including a first outer bearing part having the shape selected for the cam, a second, axial and cylindrical bearing part configured to match said internal, axial bearing part of the circular cross-section to center the cam by means of said external cylindrical bearing part on another cam's internal cylindrical bearing part, and an axial, polygonal end piece matching said polygonal recess of any other cam, so as to rotationally lock together two cams when assembled.

* * * * *